US006710273B1

(12) United States Patent
Skarlupka et al.

(10) Patent No.: US 6,710,273 B1
(45) Date of Patent: Mar. 23, 2004

(54) ONE PIECE PRE-MOLDED ENVIRONMENTAL SEAL FOR TOGGLE SWITCH

(75) Inventors: Michael J. Skarlupka, Freeport, IL (US); Nathan W. Johnson, Winslow, IL (US); Brad L. Cummins, Freeport, IL (US); David S. Evans, Lena, IL (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/325,096

(22) Filed: Dec. 20, 2002

(51) Int. Cl.[7] ..... H01H 9/02
(52) U.S. Cl. ..... 200/302.3; 200/339
(58) Field of Search ..... 200/553, 302.1, 200/302.3, 335, 339

(56) References Cited

U.S. PATENT DOCUMENTS 2,726,105 A * 12/1955 Koenig ..... 403/133
2,916,592 A * 12/1959 Campe ..... 200/302.3
3,483,345 A * 12/1969 Hults ..... 200/302.3
4,710,601 A * 12/1987 Raab et al. ..... 200/302.3
5,660,270 A * 8/1997 Martin et al. ..... 200/315
6,380,500 B1 * 4/2002 Lin ..... 200/302.3

* cited by examiner

*Primary Examiner*—Michael A. Friedhofer
(74) *Attorney, Agent, or Firm*—Kris T. Fredrick

(57) ABSTRACT

A toggle switch has a switch cover, a toggle lever, and a one piece pre-molded seal. The switch cover has an opening, and the toggle lever extends through the opening into the switch cover. A neck of the one piece pre-molded seal surrounds the toggle lever and provides sealing between the toggle lever and the switch cover. The one piece pre-molded seal also may have a planar portion that provides sealing at an interface between the switch case and the switch cover.

38 Claims, 3 Drawing Sheets

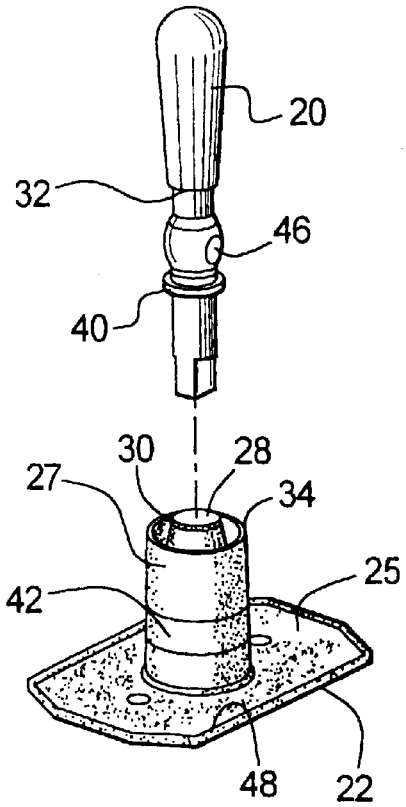
FIG. 4
FIG. 5
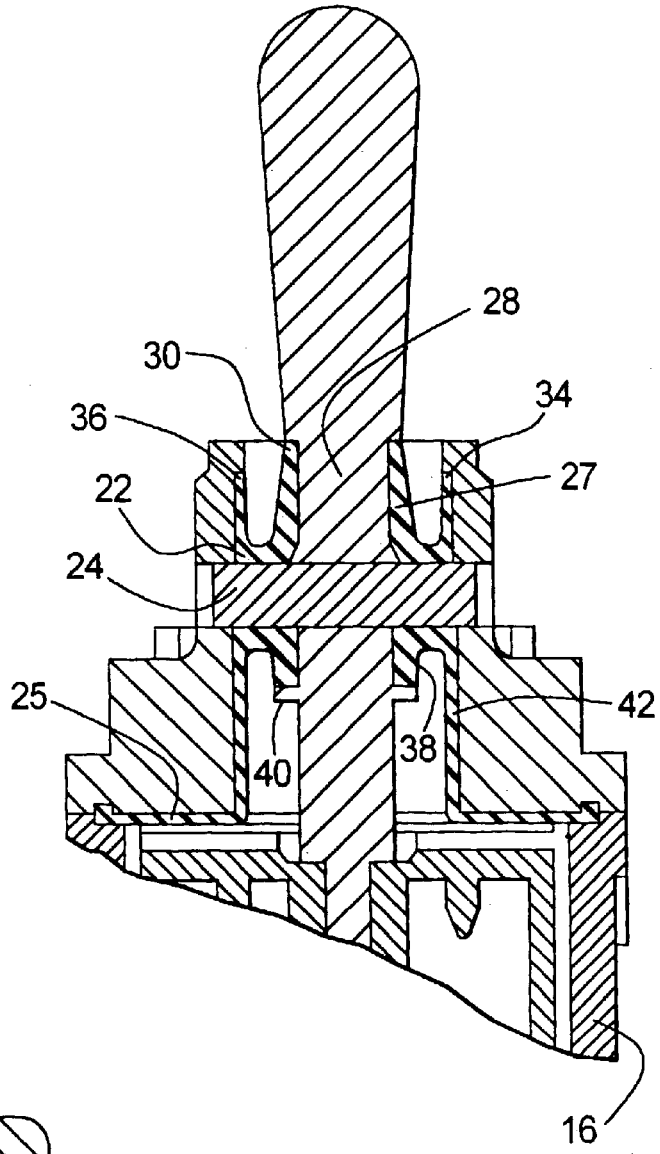
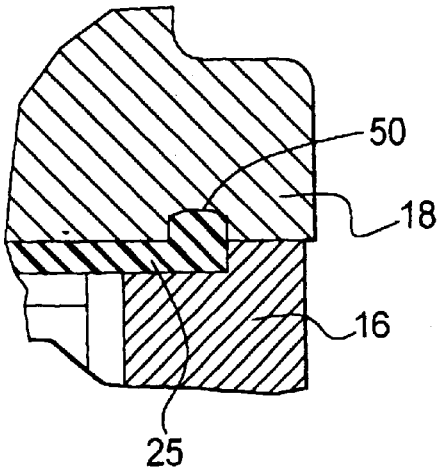
FIG. 6

ONE PIECE PRE-MOLDED ENVIRONMENTAL SEAL FOR TOGGLE SWITCH

TECHNICAL FIELD OF THE INVENTION

The present invention relates to the sealing of toggle switches, such as panel mounted toggle switches, in order to prevent moisture and other contaminants from passing through the switch.

BACKGROUND OF THE INVENTION

A toggle switch has a toggle lever that is typically pivoted about a pin in order to control the position of a switch. The pin passes through a bushing and the toggle lever so as to support the toggle lever. Toggle switches are used in a variety of applications and are frequently mounted to panels such that the toggle levers of the toggle switches protrude from one side of the panels and extend through the panels to operate switches on the other side of the panels. A seal is usually provided between the toggle lever and the switch in order to prevent moisture and other contaminants from passing around the toggle lever and into the switch.

The current method of sealing a toggle switch is to over mold the toggle switch with a material such that the material fills the area between the bushing and the lever/pin combination. This over molding process is a specialized process that is expensive to implement. The present invention is directed to a less expensive seal.

SUMMARY OF THE INVENTION

In accordance with one aspect of the present invention, a toggle switch comprises a switch cover, a toggle lever, a seal guard, and a one piece pre-molded seal. The switch cover has an opening. The toggle lever extends through the opening of the switch cover. The seal guard is associated with one of the switch cover and the toggle lever. The one piece pre-molded seal surrounds the toggle lever and provides sealing between the toggle lever and the switch cover, and the one piece pre-molded seal abuts the seal guard.

In accordance with another aspect of the present invention, a toggle switch comprises a switch cover, a switch case, a toggle lever, and a one piece pre-molded seal. The switch cover has an opening. The toggle lever extends through the opening of the switch cover. The one piece pre-molded seal has a neck portion and a planar portion, the neck portion surrounds the toggle lever and provides sealing between the toggle lever and the switch cover, and the planar portion provides sealing at an interface between the switch case and the switch cover.

In accordance with still another aspect of the present invention, a toggle switch comprises a switch cover having an opening, a switch case, a toggle lever, a pin, and a one piece pre-molded seal. The toggle lever extends through the opening of the switch cover and into the switch case. The pin extends through the switch cover and the toggle lever so as to form a pivot for the toggle lever. The one piece pre-molded seal has first and second portions. The first portion surrounds the toggle lever and the pin to provide sealing between the toggle lever and the switch cover and around the pin, and the second portion is between the switch cover and the switch case.

BRIEF DESCRIPTION OF THE DRAWINGS

These and other features and advantages will become more apparent from a detailed consideration of the invention when taken in conjunction with the drawings in which:

FIG. 4 is an exploded view of the toggle lever and seal of the toggle lever subassembly of FIG. 2;

FIG. 5 is a cross-sectional view of the toggle switch shown in FIG. 1;

FIG. 6 shows detail of the switch case and the switch cover of the toggle switch shown in FIG. 1;

DETAILED DESCRIPTION

A toggle switch 10 according to one embodiment of the present invention is shown in FIGS. 1–6. The toggle switch 10 includes a toggle lever subassembly 12 and a switch subassembly 14 that are joined together in known fashion. The switch subassembly 14 includes a switch case 16 that houses a switch (not shown).

Figure 1:
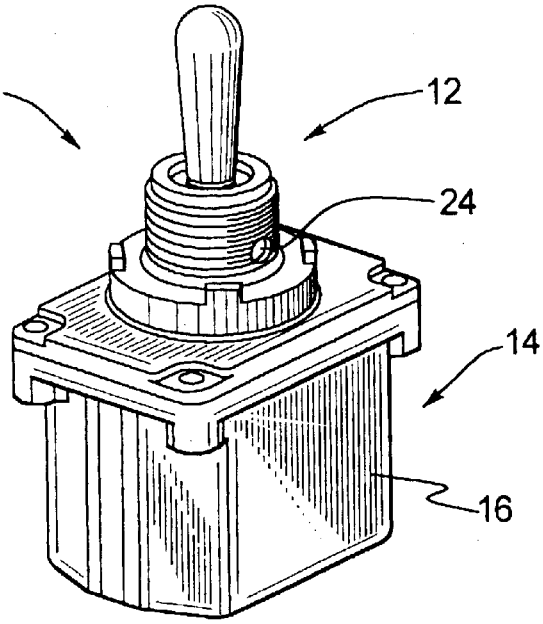
FIG. 1 is an isometric view of a toggle switch according to one embodiment of the present invention.
Figure 3:
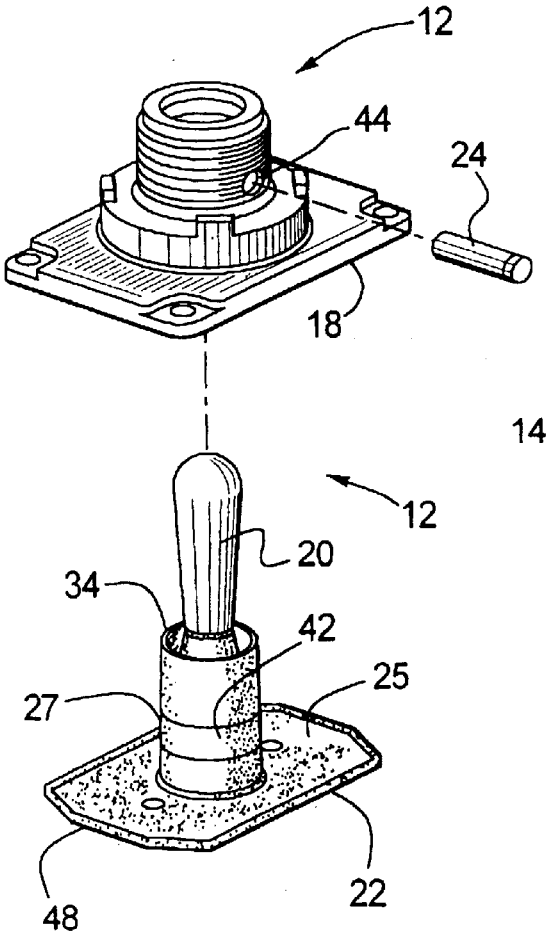
FIG. 3 shows the toggle lever subassembly of FIG. 2 in greater detail.

A switch cover 18 of the toggle lever subassembly 12 abuts the switch case 16 when the toggle lever subassembly 12 and the switch subassembly 14 are joined together as shown in FIG. 1. As shown in FIG. 3, the toggle lever subassembly 12 includes the switch cover 18, a toggle lever 20, a one piece pre-molded seal 22, and a pin 24.

The one piece pre-molded seal 22 has a planar portion 25 that is sandwiched between the underside of the switch cover 18 and an upper outwardly facing quadrilateral rim 26 of the switch case 16 when the toggle lever subassembly 12 and the switch subassembly 14 are joined together. The one piece pre-molded seal 22 also has a neck portion 27 extending away from the planar portion 25.

As shown in FIGS. 4 and 5, the neck portion 27 of the one piece pre-molded seal 22 has an opening 28 that receives the toggle lever 20. The one piece pre-molded seal 22 has an upwardly facing circular inner rim 30 that engages and is captured by a bottom surface of a corresponding downwardly facing circular ledge 32 of the toggle lever 20. The one piece pre-molded seal 22 also has an upwardly facing circular outer rim 34 that engages and is captured by a bottom surface of a corresponding downwardly facing circular ledge 36 of the switch cover 18. The one piece pre-molded seal 22 further has a downwardly facing circular inner rim 38 that engages and is captured by a top surface of a corresponding upwardly facing circular ledge 40 of the toggle lever 20. Finally, the one piece pre-molded seal 22 has a downwardly extending outer cylindrical portion 42 that joins the planar portion 25 and the neck portion 27 of the one piece pre-molded seal 22.

Accordingly, the downwardly facing circular ledge 32 of the toggle lever 20 provides a seal guard that engages and captures the upwardly facing circular inner rim 30 of the one piece pre-molded seal 22, the downwardly facing circular ledge 36 of the switch cover 18 provides a seal guard that engages and captures the upwardly facing circular outer rim 34 of the one piece pre-molded seal 22, and the upwardly facing circular ledge 40 of the toggle lever 20 provides a seal guard that engages and captures the downwardly facing circular inner rim 38 of the one piece pre-molded seal 22. These seal guards enhance the sealing capability of the one piece pre-molded seal 22.

The switch cover 18 and the toggle lever 20 have matching pin receiving holes 44 and 46, respectively, that receive the pin 24. The pin 24 acts as a pivot for the toggle lever 20. Moreover, as shown in FIGS. 3, 4, and 6, the planar portion 25 of the one piece pre-molded seal 22 has a ridge 48 that is pressed into a matching recess 50 of the switch cover 18 when the toggle lever subassembly 12 and the switch subassembly 14 are joined together.

During assembly, the toggle lever 20 is pushed through the one piece pre-molded seal 22, and the toggle lever 20 and the one piece pre-molded seal 22 are inserted through the switch cover 18 until the matching pin receiving holes 44 and 46 in the switch cover 18 and the toggle lever 20 align.

In this position, the upwardly facing circular inner rim 30 of the one piece pre-molded seal 22 engages the downwardly facing circular ledge 32 of the toggle lever 20, the upwardly facing circular outer rim 34 of the one piece pre-molded seal 22 engages the downwardly facing circular ledge 36 of the switch cover 18, and the downwardly facing circular inner rim 38 of the one piece pre-molded seal 22 engages the upwardly facing circular ledge 40 of the toggle lever 20.

Figure 2:
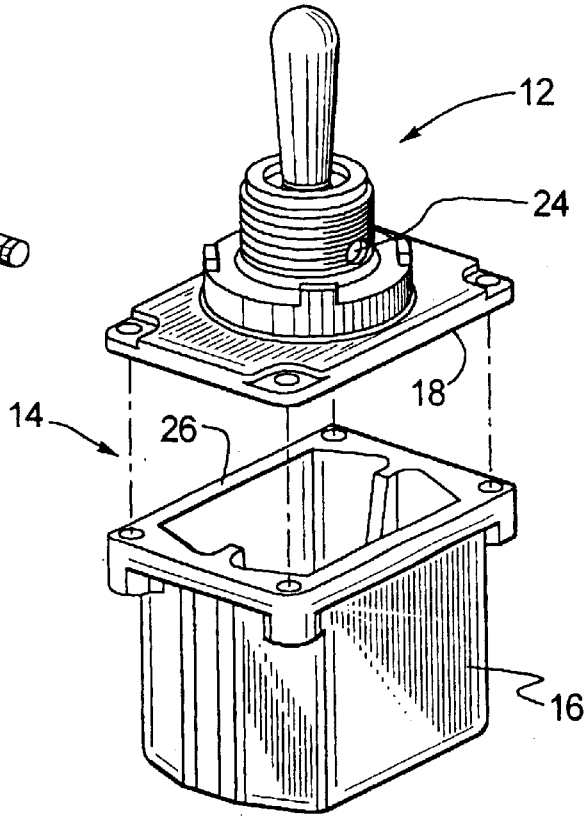
FIG. 2 is a view showing the separate toggle lever and switch subassemblies of the toggle switch shown in FIG. 1.

The pin 24 is then pushed through the matching pin receiving holes 44 and 46 and the one piece pre-molded seal 22, and is suitably pressed in or otherwise fastened to the switch cover 18. Accordingly, the toggle lever subassembly 12 is formed as shown in FIGS. 2 and 5. The toggle lever subassembly 12 is applied to the switch subassembly 14 such that the toggle lever 20 extends into the switch case 16 to engage the switch housed therein as shown in FIG. 5. The upper outwardly facing quadrilateral rim 26 of the switch case 16 presses the ridge 48 of the planar portion 25 of the one piece pre-molded seal 22 into the matching recess 50 of the switch cover 18 as the toggle lever subassembly 12 and the switch subassembly 14 are joined together such as by the use of rivets, adhesive, or other fasteners.

The use of the one piece pre-molded seal 22 results in a less expensive assembly as compared to assemblies that require the seal to be over molded onto the toggle switch as is the current practice. The one piece pre-molded seal 22 not only seals the area around the toggle lever 20 and the pin 24, but also the interface between the switch case 16 and the switch cover 18 and, thus, prevents the need for separate seals. The one piece pre-molded seal 22 is easy and inexpensive to produce and provides an effective, complete environmental seal without the use of epoxies or other sealants.

Figure 7:
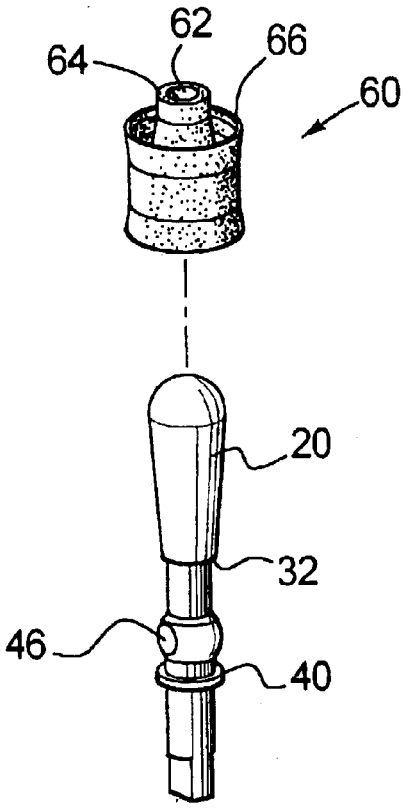
FIG. 7 is an exploded view of a toggle lever and seal according to another embodiment of the present invention.
Figure 8:
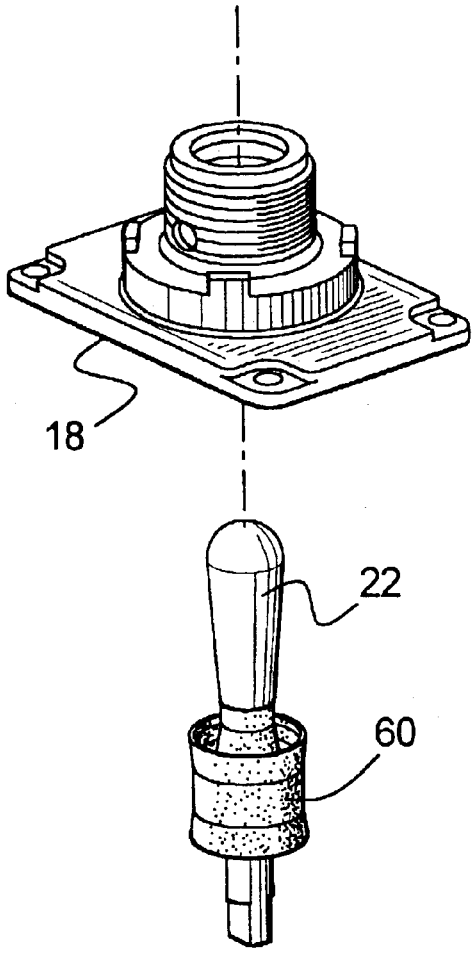
FIG. 8 shows in greater detail the toggle lever subassembly of the embodiment of FIG. 7; and, FIG. 9 is a side view of the seal shown in FIGS. 7 and 8.
Figure 9:
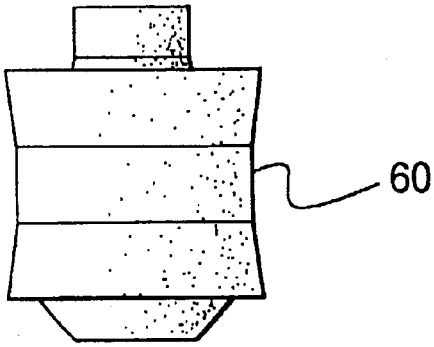

FIGS. 7 and 8 show an alternative embodiment of a one piece pre-molded seal 60 that can be used in the toggle switch 10. The one piece pre-molded seal 60 does not have the planar portion 25 of the one piece pre-molded seal 22. The one piece pre-molded seal 60 has an opening 62 to receive the toggle lever 20. The one piece pre-molded seal 22 has an upwardly facing circular inner rim 64 that engages and is captured by the downwardly facing circular ledge 32 of the toggle lever 20. The one piece pre-molded seal 60 also has an upwardly facing circular outer rim 66 that engages and is captured by the downwardly facing circular ledge 36 of the switch cover 18. The one piece pre-molded seal 60 further has a downwardly facing circular inner rim (not shown, but similar to the downwardly facing circular inner rim 38 of the one piece pre-molded seal 22) that engages and is captured by the upwardly facing circular ledge 40 of the toggle lever 20.

Accordingly, the downwardly facing circular ledge 32 of the toggle lever 20 provides a seal guard that engages and captures the upwardly facing circular inner rim 64 of the one piece pre-molded seal 60. Also, the downwardly facing circular ledge 36 of the switch cover 18 provides a seal guard that engages and captures the upwardly facing circular outer rim 66 of the one piece pre-molded seal 60. Moreover, the upwardly facing circular ledge 40 of the toggle lever 20 provides another seal guard that engages and captures the downwardly facing circular inner rim of the one piece pre-molded seal 60. These seal guards enhance the sealing capability of the one piece pre-molded seal 60.

If desired, an adhesive may be applied to the outer perimeter of the one piece pre-molded seal 60 in order to provide additional sealing between the one piece pre-molded seal 60 and the switch cover 18.

The use of the one piece pre-molded seal 60 results in a less expensive assembly as compared to assemblies that require the seal to be over molded onto the toggle switch as is the current practice. The one piece pre-molded seal 60 seals the area around the toggle lever 20 and the pin 24. The one piece pre-molded seal 60, however, does not provide a seal at the interface between the switch case 16 and the switch cover 18. A separate seal must be provided at this interface. The one piece pre-molded seal 60 is easy and inexpensive to produce and provides an effective environmental seal.

Certain modifications and/or alternatives of the present invention have been discussed above. Other modifications and/or alternatives will occur to those practicing in the art of the present invention. For example, as described above, the toggle lever 20 extends into the switch case 16 to engage a switch. Alternatively, the switch in the switch case 16 may have a switch operator that extends up into the switch cover 18, in which case the toggle lever 20 may be coupled to the switch operator in the switch cover 18. However, in this arrangement, the switch operator may be considered to be part of the toggle lever 20.

Accordingly, the description of the present invention is to be construed as illustrative only and is for the purpose of teaching those skilled in the art the best mode of carrying out the invention. The details may be varied substantially without departing from the spirit of the invention, and the exclusive use of all modifications which are within the scope of the appended claims is reserved.

We claim:

1. A toggle switch comprising:

a switch cover having an opening;

a toggle lever extending through the opening of the switch cover;

upper and lower seal guards associated with the toggle lever; and, a one piece pre-molded seal surrounding the toggle lever and providing sealing between the toggle lever and the switch cover, wherein the one piece pre-molded seal comprises upper and lower rims that engage the upper and lower seal guards of the toggle lever, respectively.

2. The toggle switch of claim 1 comprising a further seal guard associated with the switch cover, wherein the further seal guard defines the opening, and wherein the one piece pre-molded seal comprises a further rim that engages the further seal guard of the switch cover.

3. The toggle switch of claim 2 wherein the further seal guard comprises a ledge defining the opening, and wherein the further rim of the one piece pre-molded seal abuts an underside of the ledge.

4. The toggle switch of claim 1 wherein the upper seal guard comprises a ledge formed around an outer perimeter of the toggle lever, and wherein the upper rim of the one piece pre-molded seal abuts an underside of the ledge.

5. The toggle switch of claim 1 wherein the upper and lower seal guards comprise corresponding upper and lower ledges formed around an outer perimeter of the toggle lever, wherein the upper rim of the one piece pre-molded seal abuts a lower side of the upper ledge, and wherein the lower rim of the one piece pre-molded seal abuts an upper side of the lower ledge.

6. The toggle switch of claim 5 comprising a further seal guard associated with the switch cover, wherein the further seal guard defines the opening, and wherein the one piece pre-molded seal comprises a further rim that engages the further seal guard of the switch cover.

7. The toggle switch of claim 6 wherein the further seal guard comprises a downwardly facing ledges defining the opening, and wherein the further rim of the one piece pre-molded seal abuts the downwardly facing ledge.

8. A toggle switch comprising:

a switch cover having an opening;

a switch case;

a toggle lever extending through the opening of the switch cover; and, a one piece pre-molded seal having a neck portion and a planar portion, wherein the neck portion surrounds the toggle lever and provides sealing between the toggle lever and the switch cover, and wherein the planar portion provides sealing at an interface between the switch case and the switch cover.

9. The toggle switch of claim 8 wherein the switch cover comprises a seal guard defining the opening, and wherein the one piece pre-molded seal comprises a rim that engages the seal guard of the switch cover.

10. The toggle switch of claim 8 wherein the toggle lever comprises a seal guard, and wherein the one piece pre-molded seal comprises a rim that engages the seal guard of the toggle lever.

11. The toggle switch of claim 8 wherein the toggle lever comprises upper and lower seal guards, and wherein the one piece pre-molded seal comprises upper and lower rims that engage the upper and lower seal guards of the toggle lever, respectively.

12. The toggle switch of claim 8 wherein the switch cover comprises a first seal guard defining the opening, wherein the toggle lever comprises a second seal guard, and wherein the one piece pre-molded seal comprises outer and inner rims that engage the first and second seal guards, respectively.

13. The toggle switch of claim 8 wherein the switch cover comprises a first seal guard defining the opening, wherein the toggle lever comprises second and third seal guards, wherein the second seal guard is an upper seal guard on the toggle lever, wherein the third seal guard is a lower seal guard on the toggle lever, wherein the one piece pre-molded seal comprises inner and outer upper rims and a lower rim, wherein the outer upper rim engages the first seal guard, wherein the inner upper rim engages the second seal guard, and wherein the lower rim engages the third seal guard.

14. The toggle switch of claim 8 wherein the switch cover comprises a ledge defining the opening and having a bottom surface facing toward the switch case when the switch cover and the switch case are mated, and wherein the one piece pre-molded seal comprises a rim that abuts the bottom surface of the ledge.

15. The toggle switch of claim 8 wherein the toggle lever comprises a ledge formed around an outer perimeter of the toggle lever and having a bottom surface facing toward the switch case when the switch cover and the switch case are mated, and wherein the one piece pre-molded seal comprises a rim that abuts the bottom surface of the ledge.

16. The toggle switch of claim 8 wherein the toggle lever comprises an upper ledge formed around an outer perimeter of the toggle lever, wherein the upper ledge has a bottom surface facing toward the switch case when the switch cover and the switch case are mated, wherein the toggle lever comprises a lower ledge formed around an outer perimeter of the toggle lever, wherein the lower ledges has a top surface facing away from the switch case when the switch cover and the switch case are mated, wherein the one piece pre-molded seal comprises an upper rim that abuts the bottom surface of the upper ledge, and wherein the one piece pre-molded seal comprises a lower rim that abuts the top surface of the lower ledge.

17. The toggle switch of claim 8 wherein the switch cover comprises a first ledge defining the opening, wherein the first ledge has a bottom surface facing toward the switch case when the switch cover and the switch case are mated, wherein the toggle lever comprises a second ledge formed around an outer perimeter of the toggle lever, wherein the second ledge has a bottom surface facing toward the switch case when the switch cover and the switch case are mated, wherein the one piece pre-molded seal comprises an outer rim that abuts the bottom surface of the first ledge, and wherein the one piece pre-molded seal comprises an inner rim that abuts the bottom surface of the second ledge.

18. The toggle switch of claim 8 wherein the switch cover comprises a first ledge defining the opening, wherein the first ledge has a bottom surface facing toward the switch case when the switch cover and the switch case are mated, wherein the toggle lever comprises a second ledge formed around an upper outer perimeter of the toggle lever, wherein the second ledge has a bottom surface facing toward the switch case when the switch cover and the switch case are mated, wherein the toggle lever comprises a third ledge formed around a lower outer perimeter of the toggle lever, wherein the third ledge has a top surface facing away from the switch case when the switch cover and the switch case are mated, wherein the one piece pre-molded seal comprises an outer rim that abuts the bottom surface of the first ledge, wherein the one piece pre-molded seal comprises an inner rim that abuts the bottom surface of the second ledge, and wherein the one piece pre-molded seal comprises a lower rim that abuts the top surface of the third ledge.

19. The toggle switch of claim 18 further comprising a pin extending through the switch cover and the toggle lever so as to form a pivot for the toggle lever.

20. The toggle switch of claim 8 wherein the switch cover has a surface facing the switch case and a recess extending into the surface, and wherein the planar portion of the seal comprises a rim pressed into the recess when the switch cover is mated to the switch case.

21. The toggle switch of claim 8 further comprising a pin extending through the switch cover and the toggle lever so as to form a pivot for the toggle lever.

22. A toggle switch comprising:

a switch cover having an opening;

a switch case;

a toggle lever extending through the opening of the switch cover and into the switch case;

a pin extending through the switch cover and the toggle lever so as to form a pivot for the toggle lever; and, a one piece pre-molded seal having first and second portions, wherein the first portion surrounds the toggle lever and the pin to provide sealing between the toggle lever and the switch cover and around the pin, and wherein the second portion is between the switch cover and the switch case.

23. The toggle switch of claim 22 wherein the switch cover comprises a ledge defining the opening, wherein the ledge has a bottom surface facing toward the switch case when the switch cover and the switch case are mated, and wherein the one piece pre-molded seal comprises a rim that abuts the bottom of the ledge.

24. The toggle switch of claim 22 wherein the toggle lever comprises a ledge formed around an outer perimeter of the toggle lever, wherein the ledge has a bottom surface facing toward the switch case when the switch cover and the switch case are mated, and wherein the one piece pre-molded seal comprises a rim that abuts the bottom of the ledge.

25. The toggle switch of claim 22 wherein the toggle lever comprises an upper ledge formed around an outer perimeter of the toggle lever, wherein the upper ledge has a bottom surface facing toward the switch case when the switch cover and the switch case are mated, wherein the toggle lever comprises a lower ledge formed around an outer perimeter of the toggle lever, wherein the lower ledge has a top surface facing away from the switch case when the switch cover and the switch case are mated, wherein the one piece pre-molded seal comprises an upper rim that abuts the bottom surface of the upper ledge, and wherein the one piece pre-molded seal comprises a lower rim that abuts the top surface of the lower ledge.

26. The toggle switch of claim 22 wherein the switch cover comprises a first ledge defining the opening, wherein the first ledge has a bottom surface facing toward the switch case when the switch cover and the switch case are mated, wherein the toggle lever comprises a second ledge formed around an outer perimeter of the toggle lever, wherein the one piece pre-molded seal comprises an outer rim that abuts the bottom surface of the first ledge, and wherein the one piece pre-molded seal comprises an inner rim that abuts the second ledge.

27. The toggle switch of claim 22 wherein the switch cover comprises a first ledge defining the opening, wherein the first ledge has a bottom surface facing toward the switch case when the switch cover and the switch case are mated, wherein the toggle lever comprises a second ledge formed around an upper outer perimeter of the toggle lever, wherein the second ledge has a bottom surface facing toward the switch case when the switch cover and the switch case are mated, wherein the toggle lever comprises a third ledge formed around a lower outer perimeter of the toggle lever, wherein the third ledge has a top surface facing away from the switch case when the switch cover and the switch case are mated, wherein the one piece pre-molded seal comprises an outer rim that abuts the bottom surface of the first ledge, wherein the one piece pre-molded seal comprises an inner rim that abuts the bottom surface of the second ledge, and wherein the one piece pre-molded seal comprises a lower rim that abuts the top surface of the third ledge.

28. The toggle switch of claim 22 wherein the switch cover has a surface facing the switch case and a recess extending into the surface, and wherein the second portion of the one piece pre-molded seal comprises a rim pressed into the recess when the switch cover is mated to the switch case.

29. A toggle switch comprising:

a switch cover having an opening and an upper switch cover seal guard around the opening;

a toggle lever extending through the opening of the switch cover and having a lower toggle lever seal guard around the toggle lever, wherein the lower toggle level seal guard is distally below the switch seal guard; and, a one piece pre-molded seal surrounding the toggle lever and having upper and lower rims, wherein the upper rim engages the upper switch cover seal guard and the lower rim engages the lower toggle lever seal guard so as to provide a seal between the toggle lever and the switch cover.

30. The toggle switch of claim 29 wherein the toggle lever further comprises an upper toggle lever seal guard around the toggle lever, wherein the upper rim of the one piece pre-molded seal comprises an upper outer rim, wherein the one piece pre-molded seal further comprises an upper inner rim, and wherein the upper inner rim engages the upper toggle lever seal guard.

31. The toggle switch of claim 29 wherein the upper switch cover seal guard comprises a downwardly facing ledge of the switch cover, wherein the lower toggle lever seal guard comprises an upwardly facing ledge of the toggle lever, wherein the upper rim abuts the downwardly facing ledge of the switch cover, and wherein the lower rim abuts the upwardly facing ledge of the toggle lever.

32. The toggle switch of claim 31 wherein the toggle lever further comprises an upper toggle lever seal guard around the toggle lever, wherein the upper rim of the one piece pre-molded seal comprises an upper outer rim, wherein the one piece pre-molded seal further comprises an upper inner rim, and wherein the upper inner rim engages the upper toggle lever seal guard.

33. The toggle switch of claim 32 wherein the upper toggle lever seal guard comprises a downwardly facing ledge of the toggle lever, and wherein the upper inner rim abuts the downwardly facing ledge of the toggle lever.

34. A toggle switch comprising:

a switch cover having an opening and an upper switch cover seal guard around the opening;

a toggle lever extending through the opening of the switch cover and having an upper toggle lever seal guard around the toggle lever; and, a one piece pre-molded seal surrounding the toggle lever and having upper inner and outer rims with a valley therebetween, wherein a distance between the upper outer rim and the valley is more than half of a distance between the valley and the upper inner rim, and wherein the upper outer rim engages the upper switch cover seal guard and the upper inner rim engages the upper toggle lever seal guard so as provide a seal between the toggle lever and the switch cover.

35. The toggle switch of claim 34 wherein the toggle lever further comprises a lower toggle lever seal guard around the toggle lever, wherein the one piece pre-molded seal further comprises a lower inner rim, and wherein the lower inner rim engages the lower toggle lever seal guard.

36. The toggle switch of claim 34 wherein the upper switch cover seal guard comprises a downwardly facing ledge of the switch cover, wherein the upper toggle lever seal guard comprises a downwardly facing ledge of the toggle lever, wherein the upper outer rim abuts the downwardly facing ledge of the switch cover, and wherein the upper inner rim abuts the downwardly facing ledge of the toggle lever.

37. The toggle switch of claim 36 wherein the toggle lever further comprises a lower toggle lever seal guard around the toggle lever, wherein the one piece pre-molded seal further comprises a lower inner rim, and wherein the lower inner rim engages the lower toggle lever seal guard.

38. The toggle switch of claim 37 wherein the lower toggle lever seal guard comprises an upwardly facing ledge of the toggle lever, and wherein the lower inner rim abuts the upwardly facing ledge of the toggle lever.

* * * * *